US007077435B1

(12) United States Patent
Cowan

(10) Patent No.: US 7,077,435 B1
(45) Date of Patent: Jul. 18, 2006

(54) LABEL STRUCTURE AND METHOD OF FORMING THE LABEL STRUCTURE

(76) Inventor: Randy G. Cowan, 600 E. 52nd St. North, Sioux Falls, SD (US) 57104

( * ) Notice: Subject to any disclaimer, the term of this patent is extended or adjusted under 35 U.S.C. 154(b) by 574 days.

(21) Appl. No.: 09/931,336

(22) Filed: Aug. 16, 2001

(51) Int. Cl.
*B42D 15/00* (2006.01)

(52) U.S. Cl. ..... 283/81; 283/79; 283/101; 281/2; 281/5; 428/40.1; 428/41.7; 428/41.8; 428/42.2; 156/152

(58) Field of Classification Search ..... 281/2, 281/5; 283/79, 81, 101; 428/40.1, 41.7, 428/41.8, 42.2; 156/152
See application file for complete search history.

(56) References Cited

U.S. PATENT DOCUMENTS 4,621,837 A * 11/1986 Mack ..... 283/105
4,991,878 A * 2/1991 Cowan et al. ..... 283/81
5,021,273 A 6/1991 Kobayashi
5,074,595 A * 12/1991 Hill et al. ..... 283/81
D327,709 S 7/1992 Hagen
5,234,735 A * 8/1993 Baker et al. ..... 428/41.7
5,290,616 A * 3/1994 Cowan et al. ..... 428/41.8
5,324,559 A 6/1994 Brombacher
5,403,636 A 4/1995 Crum
5,439,721 A * 8/1995 Pedroli et al. ..... 428/42.1
5,507,901 A 4/1996 Limina et al.
5,587,222 A 12/1996 Hoffmann
5,588,239 A * 12/1996 Anderson ..... 40/630
5,674,334 A 10/1997 Instance
5,738,382 A * 4/1998 Grosskopf et al. ..... 283/81
5,804,271 A * 9/1998 Barry ..... 428/40.1
5,863,628 A 1/1999 Barry
5,866,219 A * 2/1999 McClure et al. ..... 428/40.1
5,951,054 A 9/1999 Hagen et al.
5,972,455 A * 10/1999 Barry ..... 428/40.1
6,027,598 A * 2/2000 Anderson ..... 156/253
6,027,780 A 2/2000 Treleaven et al.
6,057,019 A * 5/2000 Barry ..... 428/40.1
6,120,637 A * 9/2000 Barry ..... 156/252
6,254,137 B1 * 7/2001 Baum et al. ..... 283/81
6,306,476 B1 * 10/2001 Barry ..... 428/40.1
6,329,034 B1 * 12/2001 Pendry et al. ..... 428/40.1
6,398,263 B1 * 6/2002 Treleaven et al. ..... 283/81
6,432,500 B1 * 8/2002 Jones et al. ..... 428/40.1

(Continued)

FOREIGN PATENT DOCUMENTS

EP 0506202 A1 * 3/1992

(Continued)

*Primary Examiner*—Boyer Ashley
*Assistant Examiner*—Mark Henderson
(74) *Attorney, Agent, or Firm*—Jeffrey A. Proehl; Woods, Fuller, Shultz & Smith P.C.

(57) ABSTRACT

A label structure and method, with the label structure including a base panel for affixing to a surface and having a back face having an adhesive applied thereon. A first leaflet is positioned adjacent to a front face of the base panel. The first leaflet comprises a first folded panel having a first fold extending substantially parallel to a first axis of the label structure. A second leaflet is positioned forward of the first leaflet such that the first leaflet is positioned substantially between the second leaflet and the base panel with the second leaflet being stacked on the first leaflet. The second leaflet comprises a second folded panel having a second fold extending substantially parallel to the first axis of the label structure. A laminating layer overlies the base panel, the first leaflet, and the second leaflet.

16 Claims, 8 Drawing Sheets

U.S. PATENT DOCUMENTS

| | | | | |
|---|---|---|---|---|
| 6,439,614 | B1 * | 8/2002 | Cowan | 283/81 |
| 6,447,862 | B1 * | 9/2002 | Rankin et al. | 428/40.1 |
| 6,531,023 | B1 * | 3/2003 | Barry | 156/256 |
| 6,541,090 | B1 * | 4/2003 | Grosskopf et al. | 428/40.1 |
| 6,645,592 | B1 * | 11/2003 | Cowan | 428/41.8 |
| 2001/0004152 | A1 * | 6/2001 | Treleaven et al. | 283/81 |
| 2001/0011821 | A1 * | 8/2001 | Lind | 283/81 |

FOREIGN PATENT DOCUMENTS

| | | | |
|---|---|---|---|
| EP | 506202 | A1 * | 9/1992 |
| EP | 0833295 | A1 * | 9/1997 |
| EP | 833295 | A1 * | 4/1998 |
| GB | 2220886 | A1 * | 1/1990 |
| WO | WO92/04704 | * | 3/1992 |
| WO | WO98/07131 | * | 2/1998 |

* cited by examiner

LABEL STRUCTURE AND METHOD OF FORMING THE LABEL STRUCTURE

BACKGROUND OF THE INVENTION

1. Field of the Invention

The present invention relates to multiple panel labels and more particularly pertains to a new label structure and method of forming the label structure for providing a simplified label structure having a simplified manner of forming the label structure.

2. Description of the Prior Art

Safety concerns and government regulations have led to an increasing need to place relatively large amounts of information about substances (such as chemicals) directly on the containers containing the substances. The incorporation of the information onto the containers has led to the development of label assemblies that include additional printed sheets that move away from the surface of the container.

Known label assemblies include "in-line" labels in which a single folded sheet forms two panels with four pages that are available for printing. A clear overlying film secures the single folded sheet to the front of a base label. The base label has a pressure sensitive adhesive on a side of the base label opposite the single folded panel. While the assembling of this type of label may be done on a single assembly pass, the amount of information that may be printed on the in-line label is limited to what can be fit on the four pages, and thus this type of label is not suitable for conveying large amounts of product information.

Another type of known label assembly includes a leaflet comprised of a single sheet that has multiple folds to form an accordion fold of multiple panels. One panel of the single sheet is adhered to the overlying film panel, and the remainder of the panels are tucked into a pocket formed between the base label and the overlying film. Opening the pocket permits the panels to be unfolded and viewed by the user. The leaflet type of label assembly permits greater amounts of information to be conveyed on the label, but since the single sheet may extend a significant distance from the point of attachment of the sheet to the base labels, the label is highly vulnerable to loss of some of the label if the label is not carefully refolded and reinserted into the pocket formed between the overlying layer and the base label.

A variation of this label assembly incorporates a booklet in the pocket instead of the sheet with multiple folds. The booklet includes multiple folded sheets that are nested together and stapled or glued together to hold the folded sheets together. The stapling or gluing of the panels together requires a separation operation from the printing and label assembly operations, and thus the booklet formation operation cannot be performed as a single label assembling operation. The additional, separate booklet printing and binding process typically requires additional space and expense.

As a general consideration, it will be realized that the production of label structures is less expensive per unit (and in the aggregate) when the number of production operations or steps is reduced. These production steps include, for example, applying strips or bands of adhesive to the component webs (to adhere them together) and trimming or cutting of the component webs (to a final size and shape) during the formation of the label structures. Thus, the elimination, or at least the minimization, of the number of these production steps allows the production of the label structures at a lower cost than when additional adhesive application and trimming steps are needed to produce the label.

The label structure and method of forming the label structure according to the present invention substantially departs from the conventional concepts and designs of the prior art, and in so doing provides a system providing a simplified label structure having a simplified manner of forming the label structure.

SUMMARY OF THE INVENTION

In view of the foregoing disadvantages inherent in the known types of multiple panel labels now present in the prior art, the present invention provides a new label structure and method of forming the label structure wherein the same can be utilized for providing a simplified label structure having a simplified manner of forming the label structure.

To attain this, the present invention generally comprises a label structure including a base panel for affixing to a surface and having front and back faces, with the back face having an adhesive applied thereon. A first leaflet is positioned adjacent to the front face of the base panel, and against the front face of the base panel. The first leaflet comprises a first folded panel having a first fold, with the first fold extending substantially parallel to a first axis of the label structure. A second leaflet is positioned forward of the first leaflet such that the first leaflet is positioned substantially between the second leaflet and the base panel such that the second leaflet is stacked on the first leaflet. The second leaflet comprises a second folded panel having a second fold extending substantially parallel to the first axis of the label structure. A laminating layer overlies the base panel, the first leaflet, and the second leaflet. A back face of the laminating layer is adhered to a portion of the base panel. The back face of the laminating layer is adhered to the first area of the front face of the base panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF A PREFERRED EMBODIMENT

Figure 1:
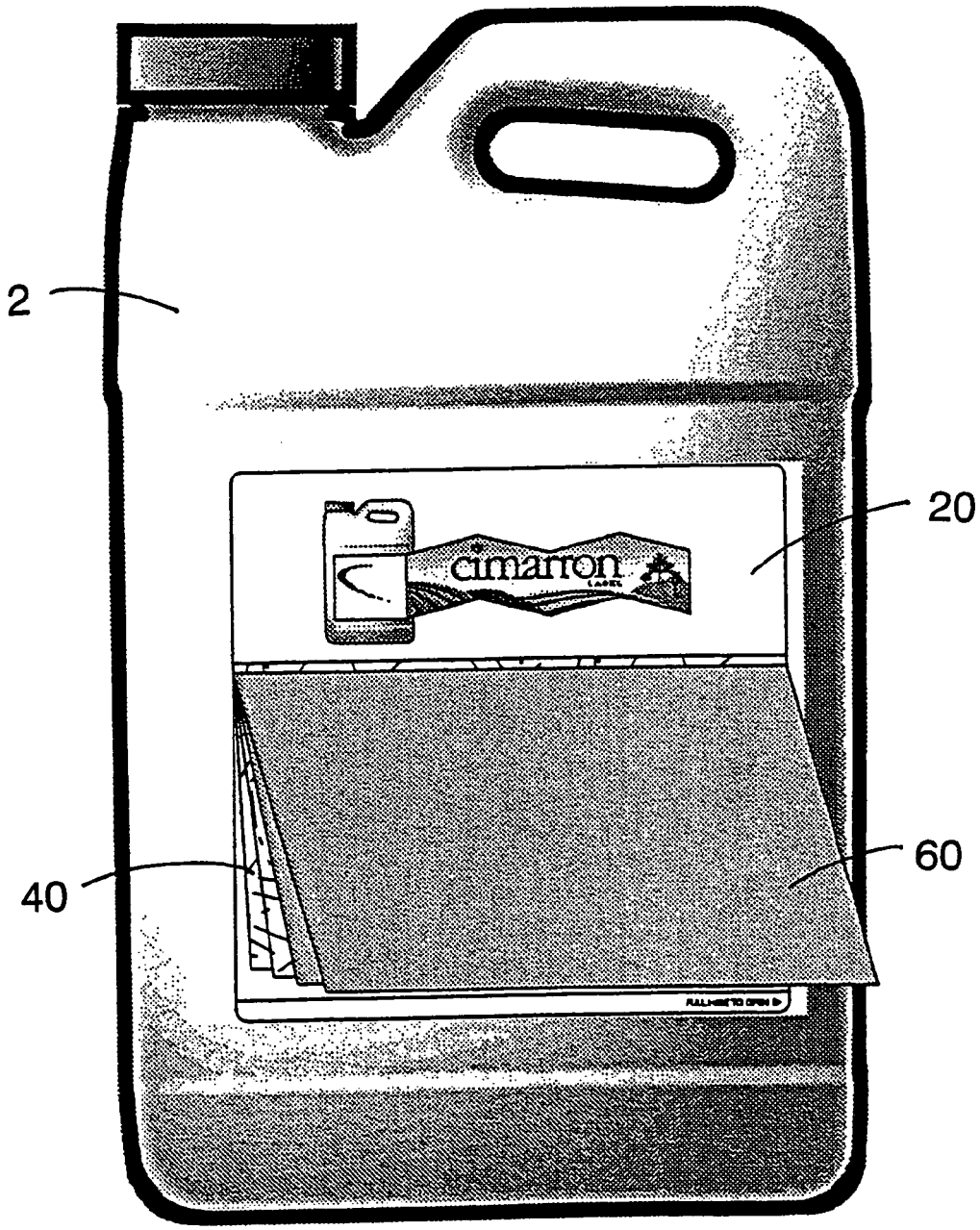
FIG. 1 is a schematic front view of a new label structure according to the present invention mounted on a container.
Figure 2:
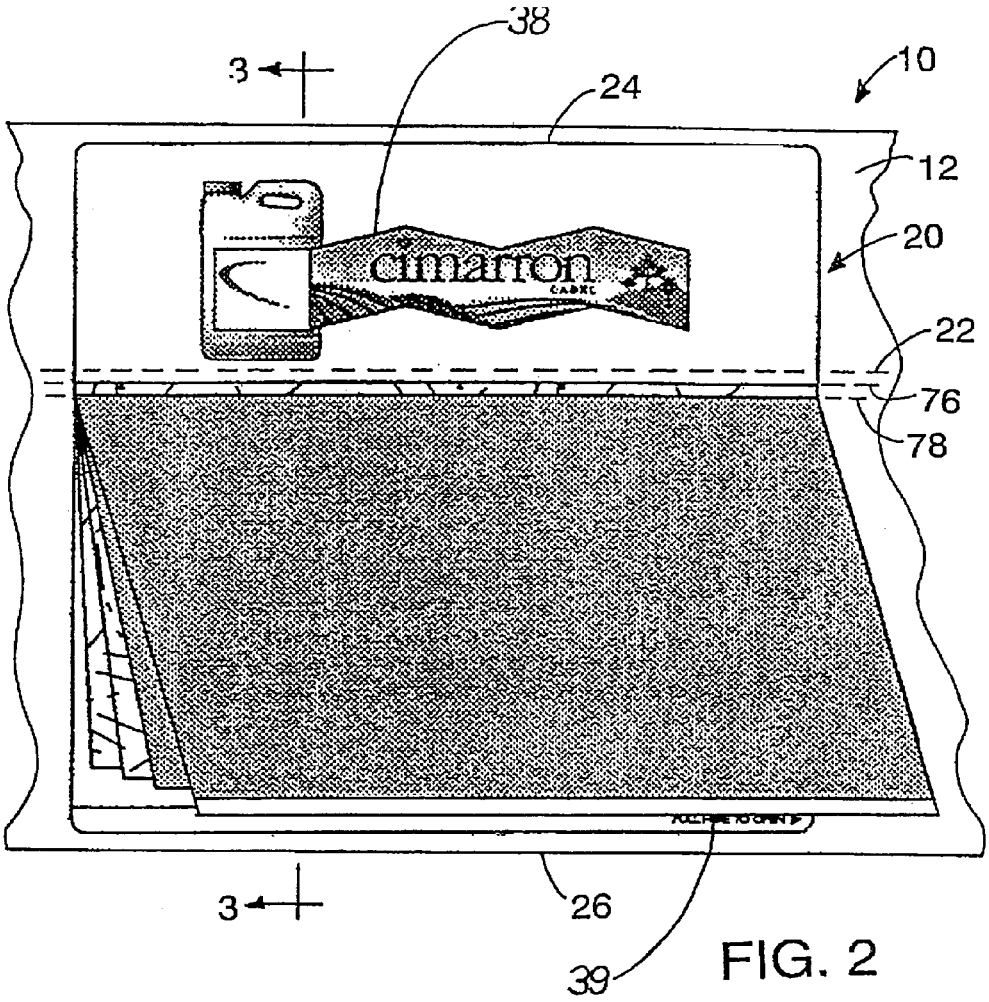
FIG. 2 is a schematic front view of the label structure of the present invention.
Figure 3:
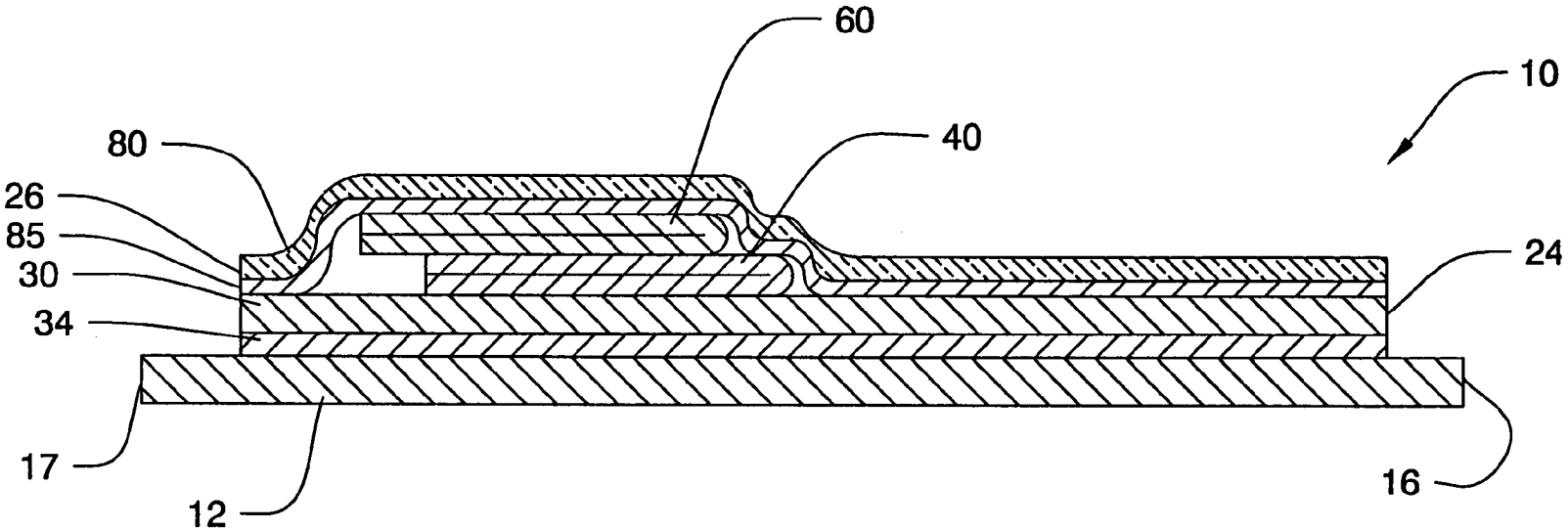
FIG. 3 is a schematic sectional view of the label structure of the present invention (in a closed condition) taken along line 3—3 of FIG. 2.
Figure 4:
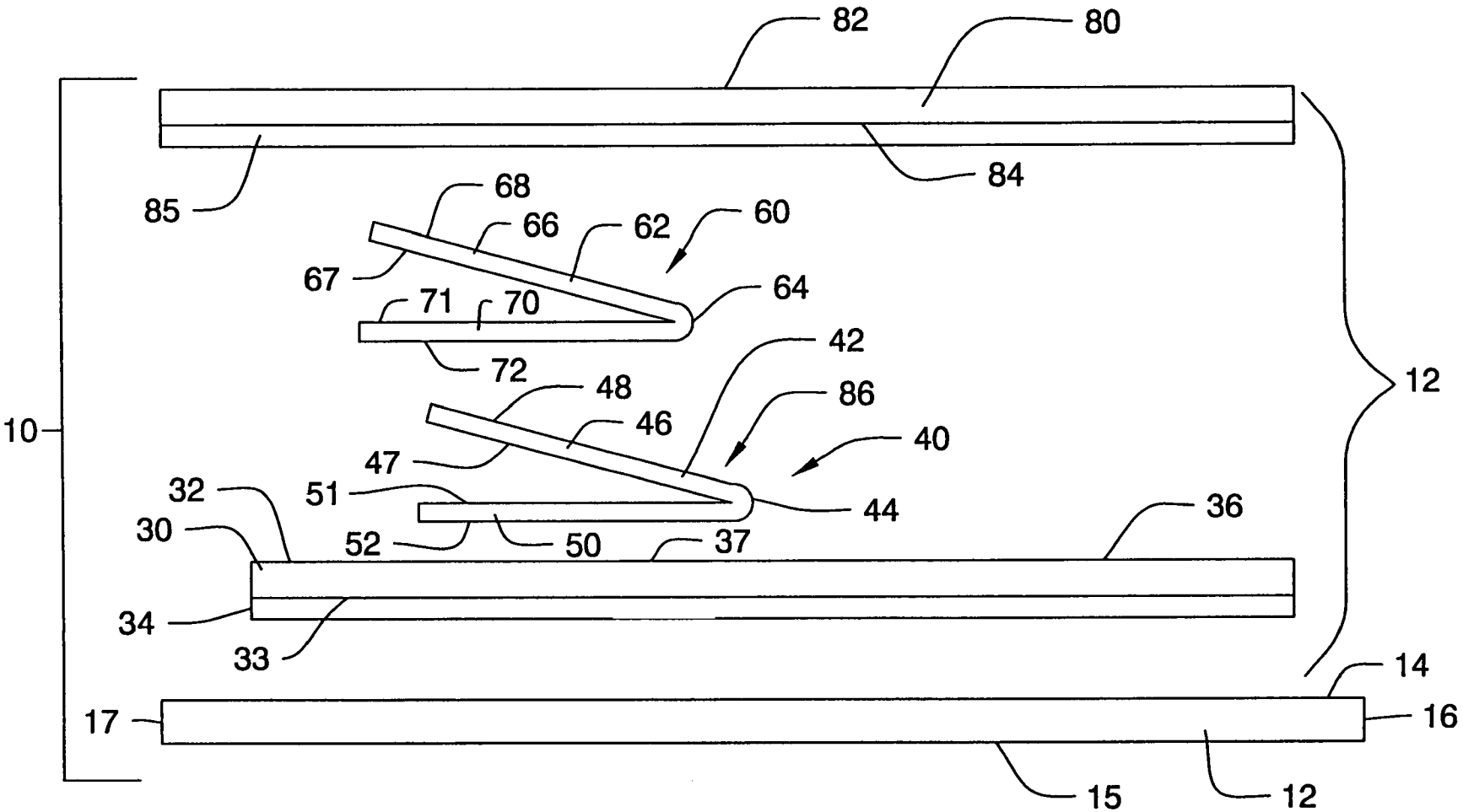
FIG. 4 is a schematic exploded side view of the label structure of the present invention.
Figure 5:
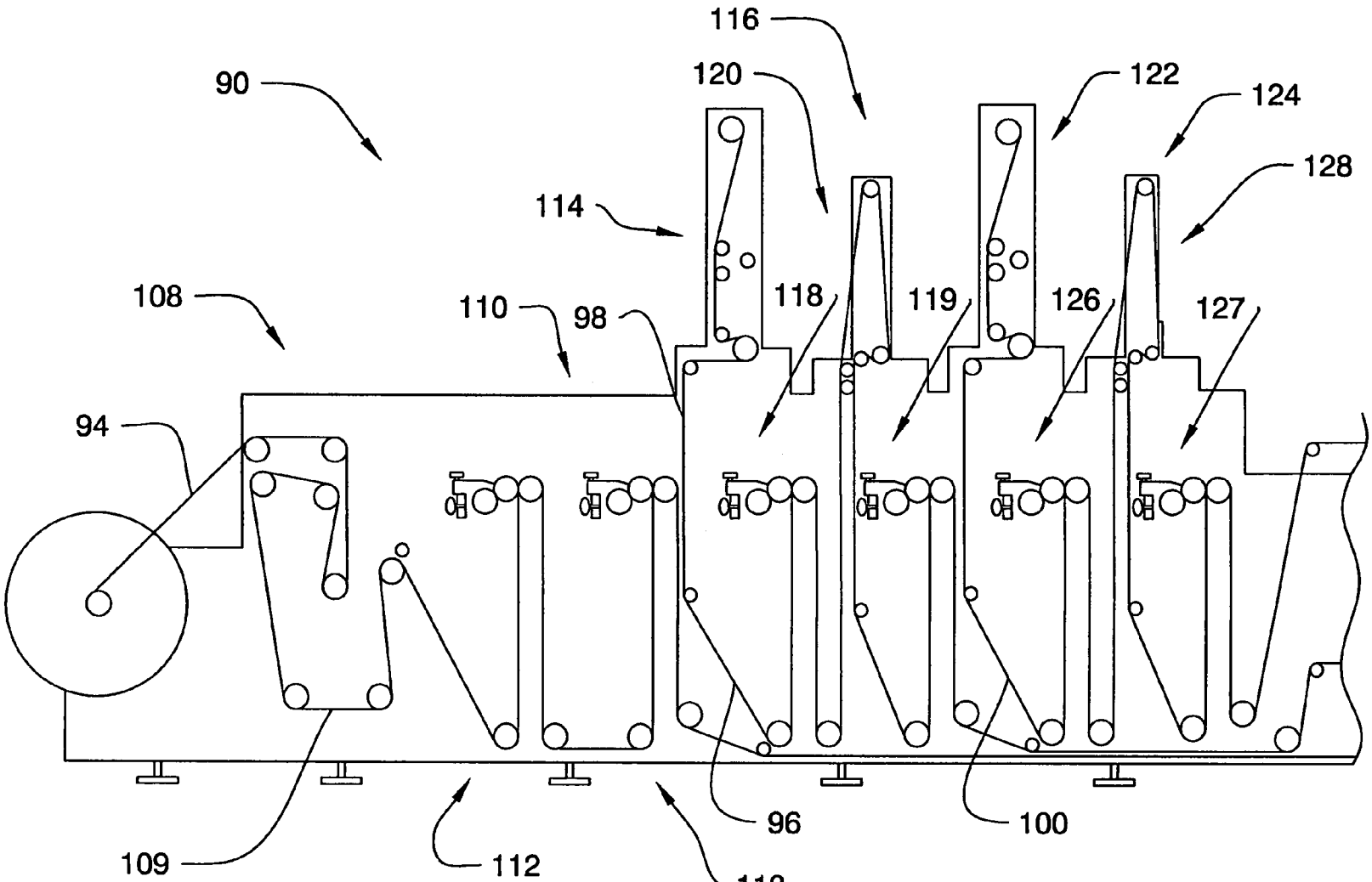
FIG. 5 is a schematic side view of a first portion of a label structure forming apparatus of the present invention.
Figure 6:
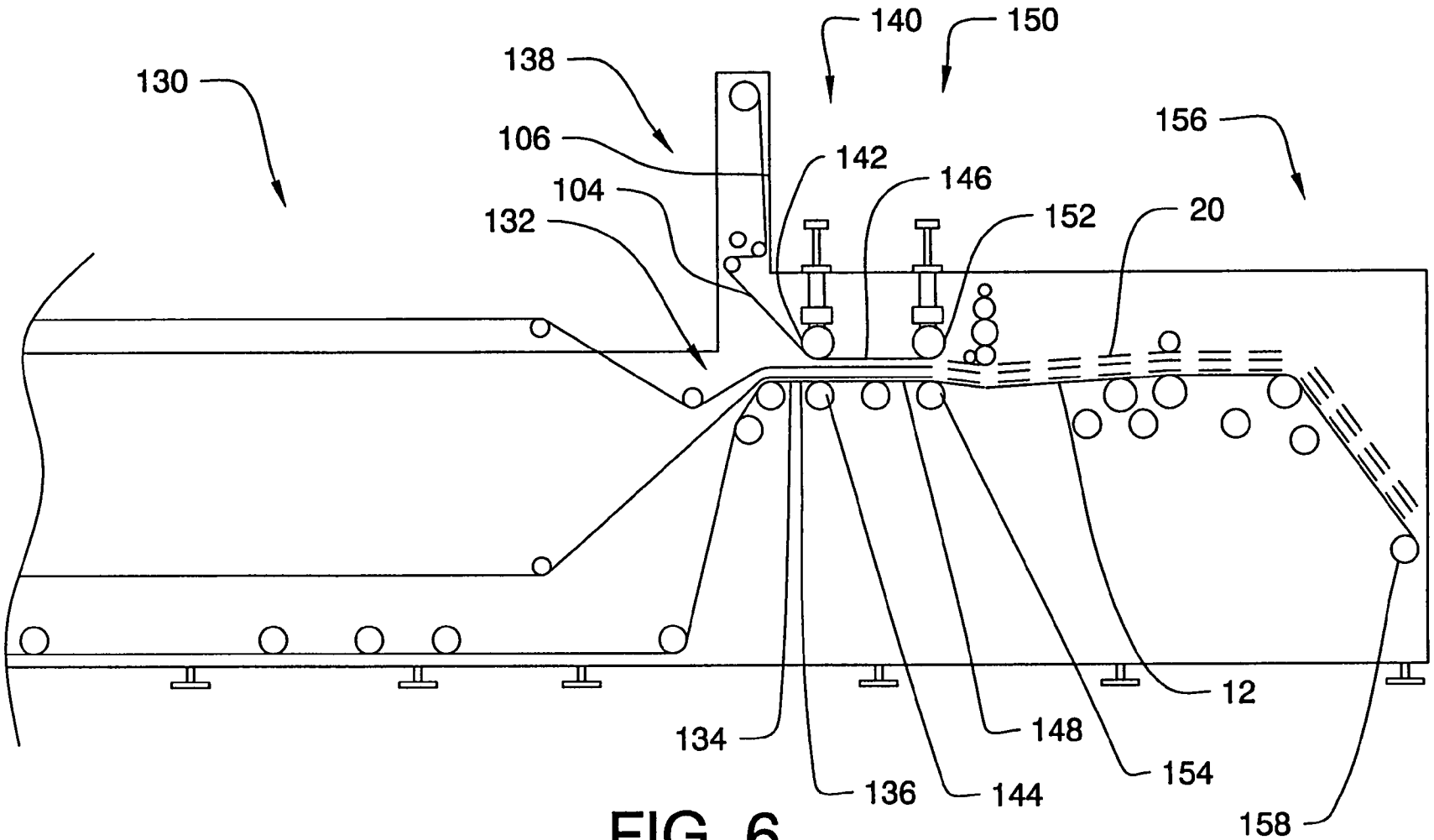
FIG. 6 is a schematic side view of a second portion of the label structure forming apparatus of the present invention.
Figure 7:
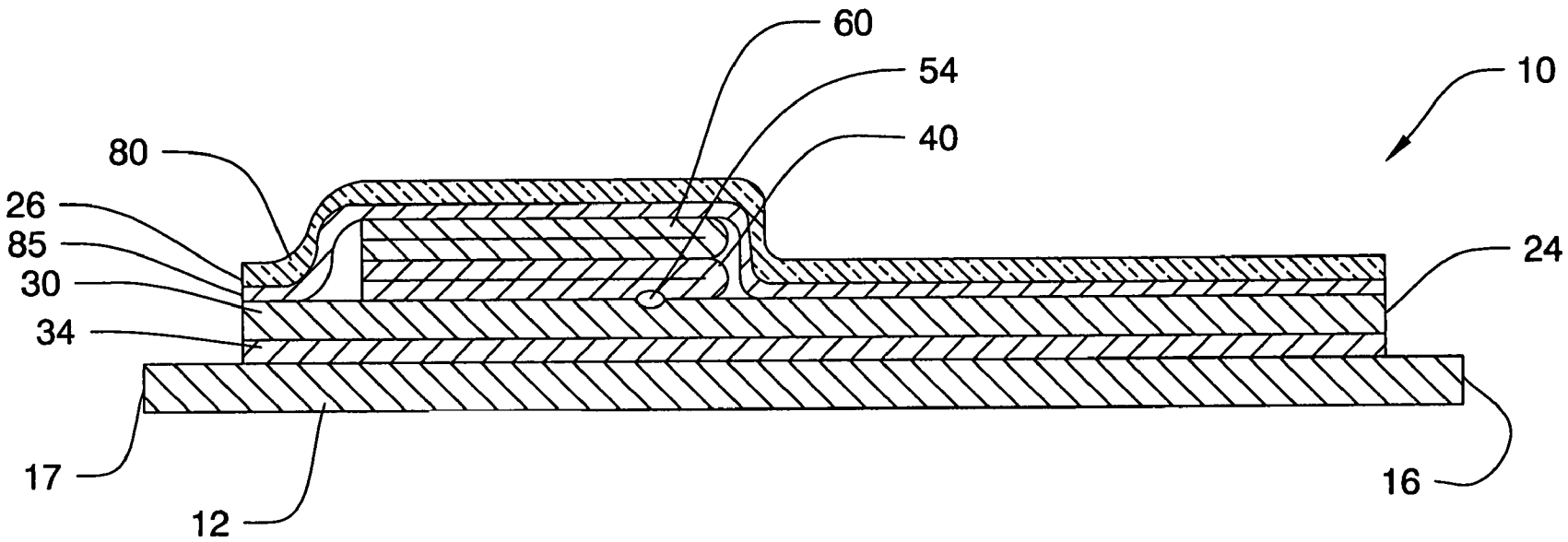
FIG. 7 is a schematic sectional view of an optional embodiment of the label structure of the present invention (in a closed condition).
Figure 8:
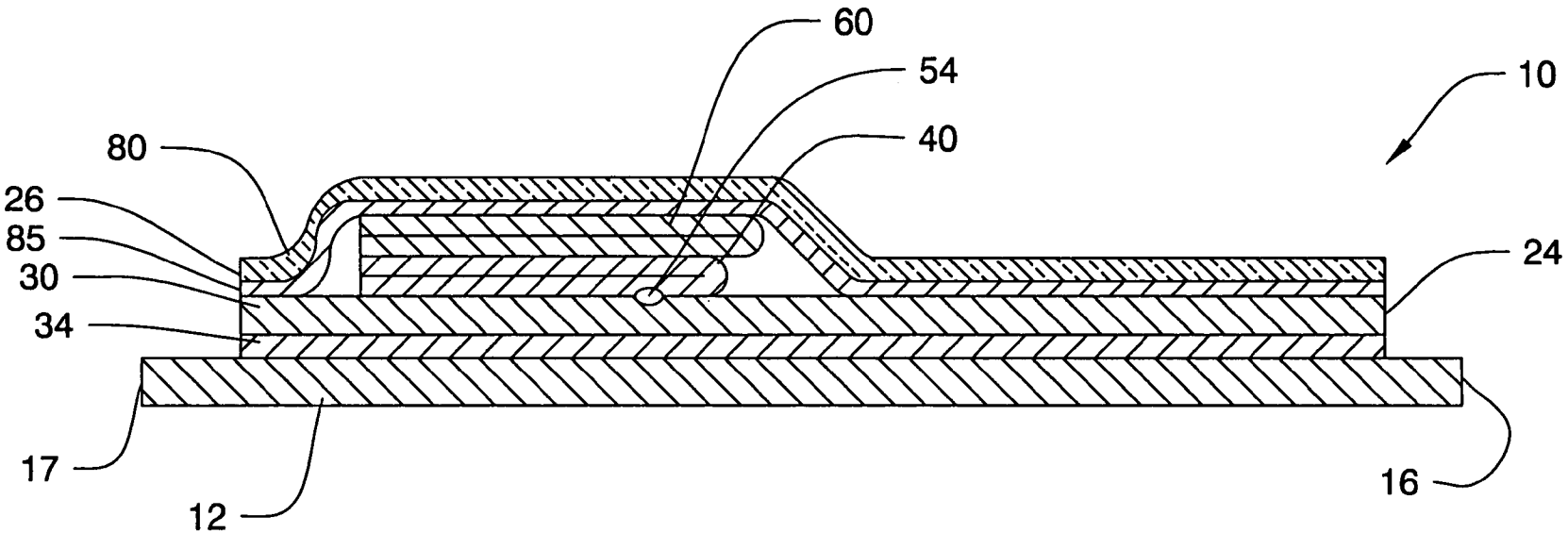
FIG. 8 is a schematic sectional view of a further optional embodiment of the label structure of the present invention (in a closed condition).

With reference now to the drawings, and in particular to FIGS. 1 through 8 thereof, a new label structure and method of forming the label structure embodying the principles and concepts of the present invention and generally designated by the reference numeral 10 will be described.

As best illustrated in FIGS. 1 through 4, the invention includes a label system 10 including a label structure 20, an apparatus for forming the label system, and a method of forming the label system.

One aspect of the invention is the label system 10, which includes a liner 12 and a label structure 20. The liner 12 is provided for carrying at least one label structure after the label structure is formed and prior to application of the label structure to a surface, such as on a container 2. The liner 12 may comprise an elongate web of material that may be coiled about a spool with a plurality of the label structures applied thereon. The elongate liner 12 may have a longitudinal extent or axis that extends along a longitudinal extent of the liner. The liner 12 has front 14 and back 15 faces, and first 16 and second 17 side edge. The first 16 and second 17 side edges may extend substantially parallel to the longitudinal extent of the liner. The front face 14 of the liner preferably comprises a release surface that permits peeling of the label structure from the front face. Illustratively, a silicone composition may be applied to the front face 14 to form the release surface, and the liner may comprise a paper material. Other materials may also be suitable for forming the liner 12.

The label structure 20 may be removably applied to and carried on the liner 12 as a means of storing the label structure prior to application of the label structure to a surface, such as, for example, of a container. The label structure generally has a first axis 22 or extent that extends substantially parallel to the longitudinal extent of the liner, and also the side edges 16, 17 of the liner. The label structure 20 has a first side 24 and a second side 26 that may extend substantially parallel to the first axis 22.

In one embodiment of the invention, the label structure 20 comprises an assembly of a base panel 30, a first leaflet 40, a second leaflet 60, and a laminating layer 80. The base panel 30 is provided for affixing to a surface, such as on a product. The base panel 30 has front 32 and back 33 faces. The back face 33 of the base panel 30 may have an adhesive 34 applied thereon for releasably affixing the base panel on the release surface of the liner, and subsequently on a surface. The adhesive 34 preferably comprises a pressure sensitive adhesive, although other types of adhesive may optionally be used. The base panel 30 may be substantially opaque such that indicia marked thereon are more easily readable on the front face 32. The front face 32 of the base panel 30 may have first 36 and second 37 areas. Indicia 38, such as alphanumeric characters and/or logos, may be marked on the first area of the front face of the base panel. Similarly, indicia 39 may be marked on the second area of the front face of the base panel.

The first leaflet 40 is positioned adjacent to the front face 32 of the base panel 30, and preferably is positioned against the front face of the base panel. The first leaflet 40 may comprises a first folded panel 42. The first folded panel 42 has a first fold 44, and the first fold may extend substantially parallel to the first axis 22 of the label structure. The first fold 44 divides the first folded panel 42 into a pair of first leaves 46, 50. Each of the first leaves 46, 50 has an inner page face 47, 51 and an outer page face 48, 52.

The inner page faces 47, 51 of the first leaves 46, 50 are oriented inwardly toward each other, and the outer page faces 48, 52 of the first leaves are oriented outwardly away from each other. The pair of first leaves 46, 50 comprise a front first leaf 46 and a back first leaf 50. The outer page face 52 of the back first leaf 50 is oriented toward the front face 32 of the base panel 30, and may be positioned adjacent to the front face 32, and may cover a portion of the second area 37 of the front face. Each of the inner 47, 51 and outer 48, 52 page faces of the front first leaf 46 and the back first leaf 50 is adapted for permitting viewing of indicia marked thereon.

The second leaflet 60 is positioned forward of the first leaflet 40 such that the first leaflet is positioned substantially between the second leaflet and the base panel 30. The second leaflet 60 may thus be stacked on the first leaflet 40, which is in turn stacked on the base panel 30.

The second leaflet 60 may comprises a second folded panel 62. The second folded panel 62 has a second fold 64. The second fold 64 may extend substantially parallel to the first axis 22 of the label structure 20. The second fold 64 is positioned toward the second side 26 of the label structure 20 relative to a position of the first fold 44. The second fold 64 divides the second folded panel 62 into a pair of second leaves 66, 70. Each of the second leaves 66, 70 has an inner page face 67, 71 and an outer page face 68, 72.

The inner page faces 67, 71 of the second leaves 66, 70 are oriented inwardly toward each other and the outer page faces 67, 71 of the second leaves are oriented outwardly away from each other. The pair of second leaves comprises a front second leaf 66 and a back second leaf 70. The outer page face 72 of the back second leaf 70 is oriented toward the outer page face 48 of the front first leaf 46 of the first leaflet 40. Each of the inner 67 and outer 68 page faces of the front second leaf 66 and the back second leaf 70 are adapted for permitting viewing of indicia marked thereon.

The first fold 44 in the first folded panel 42 defines a first fold axis 76 and the second fold 64 in the second folded panel 62 defines a second fold axis 78. The first fold axis 76 may be oriented substantially parallel to the second fold axis 78. The first 76 and second 78 fold axes may be oriented substantially parallel to the first axis 22 of the label structure 20.

The laminating layer 80 overlies the base panel 30, the first leaflet 40, and the second leaflet 60. The laminating layer 80 has front 82 and back 84 faces. The back face 84 of the laminating layer 80 is adhered to a portion of the base panel 30. The back face 84 of the laminating layer is adhered to the first area 36 of the front face 32 of the base panel 30. The back face 84 of the laminating layer 80 is adhered to a portion of the second leaflet 60, and the back face 84 may be adhered to a portion of the first leaflet 40. The laminating layer 80 may be adhered to a portion of the outer page face 48 of the front first leaf 46 of the first folded panel 42. The laminating layer 80 may be adhered to a portion of the outer page face 68 of the front second leaf 66 of the second folded panel 62. The back face 84 of the laminating layer 80 has an adhesive 85 applied thereto for adhering the laminating layer to the components of the label structure. In a preferred embodiment of the invention, the adhesive on the laminating layer permits peeling of the laminating layer from and re-adhering of the laminating layer to the base panel to allow re-securing of the leaflets against the base panel by the laminating layer after viewing of the pages faces of the leaflets. The laminating layer 80 may be substantially transparent for permitting viewing of the surfaces to which the laminating layer is adhered.

Significantly, in one embodiment of the invention, the first fold axis 76 of the first leaflet 40 is transversely spaced from the second fold axis 78 of the second leaflet 60 such that the first fold axis is located relatively closer to the first side 24 of the label structure than the second fold axis. Conversely, the second fold axis 78 is located relatively closer to the second side 26 of the label structure than the first fold axis 76. The positioning of the folded panels 42, 62 in a staggered or feathered fashion permits the first folded panel 42, which is positioned between the second folded panel 62 and the base panel 30, to extend or protrude out from underneath the second folded panel. The protruding portion 86 of the first folded panel 42 is thereby exposed for being adhered to by the laminating layer 80, which holds the first folded panel in place in the label structure without having to separately adhere the first folded panel to the base panel, or adhere or staple or otherwise attach the first folded panel to the second folded panel. In the illustrative embodiment of the invention, the first leaflet 40 protrudes laterally with respect to the second leaflet 60 so that the back face 84 of the laminating layer 80 may be adhered to a portion of the first leaflet for securing the first leaflet in place below the second leaflet. It should be noted that additional leaflets may be incorporated into the label structure simply by staggering the positions of the fold axis of each of the leaflets such that each of the leaflets has at least a strip (e.g., portion 86) of the front leaf adjacent to the fold being exposed and adhered to the laminating layer.

The label structure of the invention thus permits the incorporation of multiple leaflet panels into the label without requiring additional production steps for securing the leaflet panels together, such as stapling or gluing, that is often employed to hold nested leaflet panels together. Further, the label components do not require preliminary or intermediate trimming or cutting operations prior to a final cutting operation along the perimeter of the label structure. Significantly, all faces of the pages of the leaflets are viewable and therefore are available for carrying indicia, thereby maximizing the information that may be marked on the label. Preferably, the material forming the first and the second leaflets is free of adhesive (such as a pressure sensitive adhesive) for permitting printing of both the inner and outer page faces of the leaflets.

In an optional and somewhat less preferred embodiment of the invention (see FIG. 7), the first and second leaflets are stacked on the base panel such that the second fold of the second leaflet is positioned at a distance from the first side 24 that is substantially equal to, or even less than, a distance between the first fold of the first leaflet and the first side 24 of the label structure. As this configuration of the leaflets does not expose the portion of the second leaflet adjacent to the second fold to the adhesive on the lamination layer so that the adhesive holds the second leaflet in position in the label structure. As a result, adhesive 54 should be applied between the outer page face of the first leaflet and the front face of the base panel. The adhesive 54 may be applied as a continuous strip along the longitudinal extent of the base panel. As the application of the adhesive to the first leaflet requires additional material and application processing, this optional structure is less preferred to the previously described embodiment in which the first leaflet extends beyond the second leaflet and the adhesive strip is not required.

In another optional and somewhat less preferred embodiment of the invention (see FIG. 8), the first and second leaflets are stacked on the base panel such that the second fold of the second leaflet is positioned at a distance from the first side 24 that is less than a distance between the first fold of the first leaflet and the first side 24 of the label structure. Thus, the portion of the second leaflet adjacent to the second fold extends past and overlaps the first fold of the first leaflet. This optional configuration of the leaflets does not expose the portion of the second leaflet adjacent to the second fold to the adhesive on the lamination layer so that the adhesive holds the second leaflet in position in the label structure, and therefore adhesive 54 may be needed to secure the first leaflet in position.

The label structure to be formed from one, two, or more webs in a single assembly line, without requiring separate assembly processes before or after the (final) assembly line.

A label structure forming apparatus 90 of the invention (see FIGS. 5 and 6) has a longitudinal extent along which a plurality of webs of material are assembled to form the label structure, or a plurality of label structures. The label structure forming apparatus preferably defines a base panel web path 92 for a base panel web 94, a first leaflet web path 96 for a first leaflet web 98, a second leaflet web path 100 for a second leaflet web 102, and a laminating layer web path 104 for a laminating layer web 106. The second leaflet web path may be located above the first leaflet web path, and the first leaflet web path may be located above the base panel web path. Each of the web paths of the apparatus may be oriented in a common vertical plane with each other.

The label structure forming apparatus 90 may include a base panel feed stage 108 for feeding a base panel web onto the base panel web path of the label structure forming apparatus. Preferably, the base panel feed stage is also adapted to feed a liner web 109 that is removably adhered to the base panel web on the back face of the base panel web. A base panel printing stage 110 may be provided for printing on a front face of the base panel web as the base panel web moves along the base panel web path. The base panel printing stage may include at least two printing sections 112, 113, with each printing section being adapted to print on the front face of the base panel. Each printing section 112, 113 may be adapted to print a different color ink on the front face.

The label structure forming apparatus 90 may also include a first leaflet feed stage 114 for feeding a first leaflet web onto the first leaflet web path of the label structure forming apparatus. The first leaflet feed stage 114 is preferably positioned in line with the base panel feed stage 108 along the longitudinal extent of the label structure forming apparatus. The first leaflet feed stage 114 may be located above the base panel web path 94.

The label structure forming apparatus 90 may also include a first leaflet printing stage 116 for printing on the first leaflet web. The first leaflet printing stage 116 may include a pair of printing sections 118, 119 with each printing section being adapted to print on one of a pair of opposite page faces of the first leaflet web. The apparatus 90 may also include a first leaflet inverting stage 120 for inverting the first leaflet web moving along the first leaflet web path 96. The first leaflet inverting stage 120 may be positioned between the pair of printing sections 118, 119 of the first leaflet printing stage 116 along the first leaflet web path such that a first one 118 of the printing sections prints on one page face of the first leaflet web and a second one 119 of the printing sections prints on another page face of the first leaflet web. The first leaflet inverting stage 120 may be located above the second one 119 of the pair of printing sections of the first leaflet printing stage on the label structure forming apparatus.

The label structure forming apparatus 90 may also include a second leaflet feed stage 122 for feeding the second leaflet web 102 onto the second leaflet web path 100 of the label forming apparatus. The second leaflet feed stage 122 may be positioned in line with the base panel feed stage 108 along the longitudinal extent of the label forming apparatus. The second leaflet feed stage 122 may be located above the base panel web path 92. The second leaflet feed stage 122 may be located above the first leaflet web path 96 on the label structure forming apparatus.

The label structure forming apparatus 90 may include a second leaflet printing stage 124 for printing on the second leaflet web 102. The second leaflet printing stage 124 may include at least a pair of printing sections 126, 127 with each printing section being adapted to print on one of a pair of opposite page faces of the second leaflet web. A second leaflet inverting stage 128 may be provided for inverting the second leaflet web 102 moving along the second leaflet web path 100, and may be positioned between the pair of printing sections 126, 127 of the second leaflet printing stage along the second leaflet web path such that a first one 126 of the printing sections prints on one page face of the second leaflet web and a second one 127 of the printing sections prints on another page face of the second leaflet web 102. The second leaflet inverting stage 128 may be located above a second one 127 of the pair of printing sections of the second leaflet printing stage of the label structure forming apparatus.

The label structure forming apparatus 90 may also include a folding stage 130 for placing a fold in each of the leaflet webs 98, 102. The folding stage 130 is adapted to form the first fold 44 in the first leaflet web 98, and the second fold 64 in the second leaflet web 102 if a second leaflet web is provided.

The apparatus 90 also includes a uniting stage 132 for uniting the base panel web 94, the first leaflet web 98, and the second leaflet web 102 into a unified web 134 comprised of the base panel, first leaflet, and second leaflet webs. The base panel web path, the first leaflet web path, and the second leaflet web path converge together at the uniting stage 132 to form the unified web 134 moving along a unified web path 136.

The label structure forming apparatus 90 includes a laminating layer feed stage 138 for feeding the laminating layer web 106 along the laminating layer web path 104 on the apparatus. The laminating layer feed stage 138 may be positioned above the unified web path 136 of the unified web 134. A laminating stage 140 may be provided for applying the laminating layer web 106 to the unified web 134. The laminating stage 140 may include a nip roll 142 and a first base roll 144. The nip roll 142 may be biased toward the first base roll 144 to force the nip roll against the first base roll. The unified web path 136 and the laminating layer web path 104 pass between the nip roll 142 and the first base roll 144 for pressing the laminating layer web 106 and the unified web 134 together into a composite web 146 moving along a composite web path 148 to adhere the adhesive on the back of the laminating layer web 106 to the first leaflet web 98, the second leaflet web 102, and the base panel web 94.

The apparatus 90 includes a trimming stage 150 for trimming portions of the base panel web, first leaflet web, second leaflet web, and laminating layer web from the liner web 109 to form the discrete label structure 20 adhered to the liner web. The trimming stage 150 includes cutting means for cutting through the laminating layer web, the first leaflet web, the second leaflet web, and the base panel web without cutting through the liner web so that portions of the webs may be removed from the liner web to form at least one, and preferably a plurality of, label structures 20 are defined as the webs are cut to form the perimeter of the label structures. The trimming stage 150 most preferably comprises a rotary die cut roll 152 and a second base roll 154, with the rotary die cut roll preferably being biased toward the second base roll. The composite web path 148 passes between the rotary die cut roll 152 and the second base roll 154 so that the die cut roll is pressed against the laminating layer web, along with the first 98 and second 102 webs and the base panel web 94.

The label structure forming apparatus may also include a spooling stage 156 for coiling the liner web 109 on a spool 158 with the label structure 20 being adhered on the liner web.

The invention also contemplates a method of forming the label structure of the invention, and the method may include providing the label structure forming apparatus 90 described above. Label structure components may be provided, including the base panel web, the liner web adhered to the back face of the base panel web, a plurality of leaflet webs 98, 102, and the laminating layer web 106. The plurality of leaflet webs provided may include the first leaflet web 98 and the second leaflet web 102.

The base panel web is fed onto the base panel web path of the label structure forming apparatus, and the first leaflet web is fed onto the first leaflet web path of the label structure forming apparatus. A first one of the inner and outer page faces of the first leaflet web may be printed, the first leaflet web may be inverted, and second one of the inner and outer page faces of the first leaflet web may then be printed. The second leaflet web may be fed onto the second leaflet web path of the label structure forming path of the label structure forming apparatus. A first one of the inner and outer page faces of the second leaflet web may be printed, the second leaflet web may be inverted, and a second one of the inner and outer page faces of the second leaflet web may be printed.

The first leaflet web may be folded to form the first fold in the first leaflet web, and the second leaflet web may be folded to form the second fold in the second leaflet web.

The first leaflet web may be positioned adjacent to a first side of the base panel web, and the first fold of the first leaflet web may be located at a first predetermined distance from a first side of the base panel web. The second leaflet web may be positioned adjacent to the first side of the base panel web such that a portion of the first leaflet web is positioned between the second leaflet web and the base panel web. The second fold of the second leaflet web may be located at a second predetermined distance from the first side of the base panel web. The first predetermined distance is preferably less than the second predetermined distance such that the first fold line being transversely spaced from the second fold line.

The base panel web, the first leaflet web, and the second leaflet web may be united together to forming a unified web. The laminating layer web may be applied to the unified web to form a composite web. A back face of the laminating layer web may be adhered to the unified web of the base panel web, the first leaflet web, and the second leaflet web. The composite web may be passed between the nip roll and the base roll of the laminating stage of the label structure forming apparatus.

Portions of the laminating layer web, base panel web, first leaflet web, and second leaflet web may be trimmed from the liner web to form a discrete label structure, or a plurality of discrete label structures, on the liner web. A perimeter of the label structures is cut through to, but not including, the liner layer web. The liner layer web may be coiled or wrapped about a spool with the label structures adhered thereon, thus providing a form that is suitable for use on label dispensing and application apparatus.

One highly useful application of the label structures and the label structure forming apparatus and method is for replacing other types of labeling systems, such as those labeling systems known as sleeve labels in which a sleeve, such as a full wrap sleeve, is positioned about a container, typically about a relatively narrower portion of the container as compared to other portions of the container. The label structure of the invention may be directly adhered to the container after the pressure sensitive adhesive on the back face of the base panel is peeled away from the liner web and the base panel is pressed against the exterior surface of the container.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A label structure having a first axis for extending substantially parallel to the longitudinal extent of a liner, the label structure having first and second sides extending substantially parallel to the first axis, the label structure having a front surface and a back surface, the label structure comprising:

a base panel for affixing to a surface, the base panel having front and back faces, the back face of the base panel having an adhesive applied thereon;

a first leaflet being positioned adjacent to the front face of the base panel, the first leaflet comprising a first folded panel with a first fold extending substantially parallel to the first axis of the label structure;

a second leaflet being positioned with respect to the first leaflet such that at least a portion of the first leaflet is positioned between the second leaflet and the base panel, the second leaflet comprising a second folded panel having a second fold extending substantially parallel to the first axis of the label structure; and a laminating layer overlying the base panel, the first leaflet, and the second leaflet, the laminating layer having a back face being adhered to a portion of the base panel;

wherein the laminating layer contacts both the second leaflet and the first leaflet.

2. The label structure of claim 1 wherein the first fold is positioned toward the first side, and the second fold is positioned closer to the second side of the label structure relative to a position of the first fold.

3. The label structure of claim 1 wherein the first fold in the first folded panel defines a first fold axis and the second fold in the second folded panel defining a second fold axis, the first fold axis being oriented substantially parallel to the second fold axis, the first and second fold axes being oriented substantially parallel to the first axis.

4. The label structure of claim 1 wherein the laminating layer is substantially transparent.

5. The label structure of claim 1 wherein the first fold divides the first folded panel into a pair of first leaves, each of the first leaves having an inner page face and an outer page face, the second fold dividing the second folded panel into a pair of second leaves, each of the second leaves having an inner page face and an outer page face.

6. The label structure of claim 1 wherein the laminating layer forms the front surface of the label structure and the base panel forms the back surface of the label structure, and wherein the second leaflet does not extend between the first leaflet and the base panel when in a closed condition.

7. The label structure of claim 1 wherein the laminating layer forms the front surface of the label structure and the base panel forms the back surface of the label structure, and wherein the first leaflet does not extend between the second leaflet and the laminating layer when in a closed condition.

8. The label structure of claim 1 wherein the first fold of the first leaflet is transversely spaced from the second fold of the second leaflet.

9. The label structure of claim 2 wherein the back face of the laminating layer is adhered to a portion of the first leaflet and a portion of the second leaflet.

10. The label structure of claim 3 wherein the first fold axis is transversely spaced from the second fold axis such that the first fold axis of the first leaflet is located relatively closer to the first side of the label structure than the second fold axis of the second leaflet.

11. The label structure of claim 10 wherein the back face of the laminating layer is adhered to a portion of the first leaflet and a portion of the second leaflet.

12. The label structure of claim 5 wherein the inner page faces of the first leaves are oriented inwardly toward each other and the outer page faces of the first leaves are oriented outwardly away from each other, the pair of first leaves comprising a front first leaf and a back first leaf, the outer page face of the back first leaf being oriented toward the front face of the base panel, the outer page face of the back first leaf being positioned adjacent to the front face of the base panel, the outer page face of the back first leaf being positioned adjacent to the second area of the front face of the base panel, each of the inner and outer page faces of the front first leaf and the back first leaf being adapted for permitting viewing of indicia marked thereon, the inner page faces of the second leaves being oriented inwardly toward each other and the outer page faces of the second leaves being oriented outwardly away from each other, the pair of second leaves comprising a front second leaf and a back second leaf, the outer page face of the back second leaf being oriented toward the outer page face of the front first leaf, each of the inner and outer page faces of the front second leaf and the back second leaf being adapted for permitting viewing of indicia marked thereon.

13. A label system comprising:

a liner for removably carrying at least one label structure, the liner being an elongate web, the liner having a longitudinal extent extending along a length of the liner, the liner having front and back faces, the front face of the liner comprising a release surface, a silicone being applied to the release surface, the liner comprising a paper product a label structure removably applied to the liner, the label structure having a first axis extending substantially parallel to the longitudinal extent of the liner, the label structure having first and second sides extending substantially parallel to the first axis, the label structure comprising:

a base panel for affixing to a surface, the base panel having front and back faces, the back face of the base panel having an adhesive applied thereon for releasably affixing the base panel on the release surface of the liner, the adhesive on the back face of the base panel being removably adhered to the release surface of the liner, the adhesive on the back face of the base panel comprising a pressure sensitive adhesive, the base panel being substantially opaque, the front face of the base panel having first and second areas, indicia being marked on the first area of the front face of the base panel, indicia being marked on the second area of the front face of the base panel;

a first leaflet being positioned adjacent to the front face of the base panel, the first leaflet being positioned against the front face of the base panel, the first leaflet comprising a first folded panel;

the first folded panel having a first fold, the first fold extending substantially parallel to the first axis of the label structure, the first fold being positioned toward the first side, the first fold dividing the first folded panel into a pair of first leaves, each of the first leaves having an inner page face and an outer page face;

the inner page faces of the first leaves being oriented inwardly toward each other and the outer page faces of the first leaves being oriented outwardly away from each other, the pair of first leaves comprising a front first leaf and a back first leaf, the outer page face of the back first leaf being oriented toward the front face of the base panel, the outer page face of the back first leaf being positioned adjacent to the front face of the base panel, the outer page face of the back first leaf being positioned adjacent to the second area of the front face of the base panel, each of the inner and outer page faces of the front first leaf and the back first leaf being adapted for permitting viewing of indicia marked thereon, a second leaflet being positioned forward of with respect to the first leaflet such that the first leaflet is positioned substantially between the second leaflet and the base panel, the second leaflet being stacked on the first leaflet, the second leaflet comprising a second folded panel, the second folded panel having a second fold, the second fold extending substantially parallel to the first axis of the label structure, the second fold being positioned toward the second side of the label structure relative to a position of the first fold, the second fold dividing the second folded panel into a pair of second leaves, each of the second leaves having an inner page face and an outer page face;

the inner page faces of the second leaves being oriented inwardly toward each other and the outer page faces of the second leaves being oriented outwardly away from each other, the pair of second leaves comprising a front second leaf and a back second leaf;

the outer page face of the back second leaf being oriented toward the outer page face of the front first leaf;

each of the inner and outer page faces of the front second leaf and the back second leaf being adapted for permitting viewing of indicia marked thereon;

wherein the first fold in the first folded panel defines a first fold axis and the second fold in the second folded panel defining a second fold axis, the first fold axis being oriented substantially parallel to the second fold axis, the first and second fold axes being oriented substantially parallel to the first axis, the first fold axis being transversely spaced from the second fold axis such that the first fold axis of the first leaflet is located relatively closer to the first side of the label structure than the second fold axis of the second leaflet;

a laminating layer overlying the base panel, the first leaflet, and the second leaflet, the laminating layer having front and back faces, the back face of the laminating layer being adhered to a portion of the base panel, the back face of the laminating layer being adhered to the first area of the front face of the base panel, the back face of the laminating layer being adhered to a portion of the first leaflet and a portion of the second leaflet, the laminating layer being adhered to a portion of the outer page face of the front first leaf of the first folded panel, the laminating layer being adhered to a portion of the outer page face of the front second leaf of the second folded panel, the back face of the laminating layer having an adhesive applied thereto, the laminating layer being substantially transparent.

14. A label structure having a first axis for extending substantially parallel to the longitudinal extent of a liner, the label structure having first and second sides extending substantially parallel to the first axis, the label structure having a front surface and a back surface, the label structure comprising:

a base panel for affixing to a surface, the base panel having front and back faces, the back face of the base panel having an adhesive applied thereon;

a first leaflet being positioned adjacent to the front face of the base panel, the first leaflet comprising a first folded panel with a first fold extending substantially parallel to the first axis of the label structure;

a second leaflet being positioned with respect to the first leaflet such that substantially an entirety of the first leaflet is positioned between the second leaflet and the base panel, the second leaflet comprising a second folded panel having a second fold extending substantially parallel to the first axis of the label structure; and a laminating layer overlying the base panel, the first leaflet, and the second leaflet, the laminating layer having a back face being adhered to a portion of the base panel.

15. A label structure having a first axis for extending substantially parallel to the longitudinal extent of a liner, the label structure having first and second sides extending substantially parallel to the first axis, the label structure having a front surface and a back surface, the label structure comprising:

a base panel for affixing to a surface, the base panel having front and back faces, the back face of the base panel having an adhesive applied thereon;

a first leaflet being positioned adjacent to the front face of the base panel, the first leaflet comprising a first folded panel with a first fold extending substantially parallel to the first axis of the label structure;

a second leaflet being positioned with respect to the first leaflet such that at least a portion of the first leaflet is positioned between the second leaflet and the base panel, the second leaflet comprising a second folded panel having a second fold extending substantially parallel to the first axis of the label structure; and a laminating layer overlying the base panel, the first leaflet, and the second leaflet, the laminating layer having a back face being adhered to a portion of the base panel;

wherein the second leaflet is stacked on the first leaflet when the first leaflet and the second leaflet are in a closed condition.

16. A label structure having a first axis for extending substantially parallel to the longitudinal extent of a liner, the label structure having first and second sides extending substantially parallel to the first axis, the label structure having a front surface and a back surface, the label structure comprising:

a base panel forming the back surface of the label structure for affixing to a surface, the base panel having front and back faces, the back face of the base panel having an adhesive applied thereon;

a first leaflet being positioned adjacent to the front face of the base panel, the first leaflet comprising a first folded panel with a first fold extending substantially parallel to the first axis of the label structure;

a second leaflet being positioned with respect to the first leaflet such that at least a portion of the first leaflet is positioned between the second leaflet and the base panel, the second leaflet comprising a second folded panel having a second fold extending substantially parallel to the first axis of the label structure; and a laminating layer forming the front surface of the label structure and overlying the base panel, the first leaflet, and the second leaflet, the laminating layer having a back face being adhered to a portion of the base panel;

wherein the laminating layer is forward of the base panel and the base panel is rearward of the laminating layer, and wherein an entirety of the second leaflet is positioned forward of the first leaflet.

* * * * *